US006183106B1

(12) United States Patent
Thummel et al.

(10) Patent No.: US 6,183,106 B1
(45) Date of Patent: Feb. 6, 2001

(54) SHOCK ABSORBENT FLASHLIGHT BULB AND REFLECTOR ASSEMBLY

(75) Inventors: Heinz F. Thummel, Salinas; Robert S. Szemeredi, Soquel; Chanchal M. Singh, Salinas, all of CA (US)

(73) Assignee: Streamlight, Inc., Norristown, PA (US)

( * ) Notice: Under 35 U.S.C. 154(b), the term of this patent shall be extended for 0 days.

(21) Appl. No.: 09/262,944

(22) Filed: Mar. 4, 1999

(51) Int. Cl.[7] ..... F21L 4/00

(52) U.S. Cl. ..... 362/188; 362/208; 362/203

(58) Field of Search ..... 362/206, 207, 362/208, 202, 205, 369, 390, 158, 267, 519

(56) References Cited

U.S. PATENT DOCUMENTS

| | | | | |
|---|---|---|---|---|
| 1,613,069 | | 1/1927 | Voorhees | 362/188 |
| 2,860,233 | | 11/1958 | Johnson | 362/369 |
| 4,657,085 | * | 4/1987 | Jacobsen | 169/43 |
| 4,914,555 | * | 4/1990 | Gammache | 362/183 |
| 4,930,856 | * | 6/1990 | Pelta | 385/87 |
| 4,967,328 | | 10/1990 | Tatavoosian | 362/267 |
| 5,070,437 | * | 12/1991 | Roberts | 362/158 |
| 5,113,326 | * | 5/1992 | Maglica | 362/158 |
| 5,309,337 | | 5/1994 | Groben | 362/206 |
| 5,317,490 | * | 5/1994 | Miller | 362/206 |
| 5,432,689 | | 7/1995 | Sharrah et al. | 362/183 |
| 5,463,541 | | 10/1995 | Greene | 362/369 |
| 5,539,628 | * | 7/1996 | Seib | 362/471 |
| 5,642,932 | * | 7/1997 | Matthews | 362/206 |
| 5,678,921 | | 10/1997 | Kish et al. | 362/205 |
| 5,823,802 | * | 10/1998 | Bartley | 439/86 |
| 5,904,414 | * | 5/1999 | Monteleone | 362/205 |
| 6,099,147 | * | 8/2000 | Ziegenfuss | 362/319 |

OTHER PUBLICATIONS

Brochure, "Carley Lamps . . . Subminiature Lamps & Reflectors", 1990.
Catalog, "Miniature & Sealed Beam Lamp Catalog", GE Lighting, Oct. 1994.
Brochure, "Philips Signalling Lamps", Philips Lighting Company, 1988.

* cited by examiner

*Primary Examiner*—Sandra O'Shea
*Assistant Examiner*—Hargobind S. Sawhney

(57) ABSTRACT

A flashlight bulb is mounted to a cylindrical bulb chassis such that the base of the light bulb is spaced apart from the top surface of the bulb chassis. A layer of resilient silicone material is positioned in the clearance space between the space-dapart base of the light bulb and the front surface of the bulb chassis to provide cushioning for axial and radial movement of the light bulb. A heat resistant resilient O-ring is inserted in an enlarged rear portion of the central bore of a reflector housing such that the internal surface of the O-ring slip fits around the cylindrical body of the light bulb to cushion the light bulb for radial movements of the light bulb and so that the light bulb remains mechanically and optically aligned with the central axis. For good cushioning the durometer of the O-ring is between 60–70 and the durometer of the silicone layer is between 50–60. The thickness of the O-ring is chosen to be sufficient to absorb shock from the bulb and the O-ring slip fits around the bulb to assure proper mechanical and optical alignment to the central axis of the bulb. A cylindrical flashlight reflector housing slideably receives the cylindrical bulb chassis. A helical spring pushes the bulb chassis towards the rear of the flashlight. Rotation of the reflector housing with respect to the battery housing moves the bulb along the axis of the flashlight to change the focus of the flashlight beam. The flashlight bulb mounting assembly also includes a second O-ring at the rear surface of the bulb chassis to provide cushioning for rearward axial movement of the bulb chassis. The battery contact ring and the battery contact coil spring are separated by an insulated washer and provide respective connections to the opposite terminals of the battery.

9 Claims, 2 Drawing Sheets

SHOCK ABSORBENT FLASHLIGHT BULB AND REFLECTOR ASSEMBLY

BACKGROUND OF THE INVENTION

1. Field of the Invention. This invention relates to flashlight assemblies and, more particularly, to a shock absorbent flashlight assembly.

2. Prior Art. One type of flashlight assembly includes a metal cylindrical battery housing which contains batteries. External threads on one end of the metal cylindrical battery housing are threaded into internal threads at one end of a cylindrical reflector subassembly. A bulb is mounted to a bulb mounting subassembly which axially moves within the reflector subassembly along the axis of the reflector subassembly. A spring mounted in the reflector subassembly biases the bulb mounting subassembly away from the reflector subassembly so that the bulb mounting subassembly contacts the one end of the metal cylindrical battery housing. The axial position of the bulb mounting subassembly within the reflector subassembly is adjusted by screwing the external threads on the one end of the metal cylindrical battery housing into and out of corresponding internal threads in the cylindrical reflector subassembly.

The bulb is mounted to the bulb mounting subassembly by inserting two lead-pins of the bulb into sockets which are pressed fit into the bulb mounting subassembly to provide a voltage from the batteries to the bulb. The reflector subassembly has an axial hole through which the bulb extends. The axial position of the bulb along the axis of the reflector is adjusted by screwing the external threads on the one end of the metal cylindrical battery housing into and out of corresponding internal threads in the cylindrical reflector subassembly. Adjustment of the axial position of the bulb along the axis of the reflector allows adjustment of the focus of the beam of light from the flashlight, as needed.

A severe environment for flashlight assembly such as described above is when it is mounted to a weapon such as a pistol or rifle and is subjected to severe shock and vibration caused primarily by recoil inertial forces produced by rapidly expanding gases generated when a bullet or projectile is fired from the weapon. In the case of an automatic pistol or rifle, another source of shock and vibration is the abrupt movement of the automatic slide-mechanism for ejecting a spent shell or cartridge and reloading an unfired shell or cartridge. This shock and vibration courses both axial and radial displacement of the bulb from the flashlight when a cylindrical coordinate system is used.

The invention is useful for other lighting applications where the flashlight or light source is subject to being dropped or subject to other shock or mechanical vibrations that may break the light bulb or filament.

It has been found that the usual pin-and-socket arrangements described above for mounting the bulb in a flashlight assembly mounted, for example, to a weapon have resulted in failure of the flashlight bulb caused by the glass envelope of the bulb striking the sides of the axial hole in the reflector. The forces caused, for example, by firing the weapon also can misalign the bulb in the sockets so that it is not centered along the axis of the flashlight resulting in an uneven plume of light.

Consequently, a need exists for a technique to reduce shock or vibration induced failures flashlight assembly. A need also exists for keeping a bulb properly aligned within a flashlight assembly.

SUMMARY OF THE INVENTION

It is therefore an object of the invention to provide an improved shock absorbent flashlight assembly which provides reduced shock or vibration induced failures.

It is another object of the invention to provide an improved weapon-mounted shock-absorbent flashlight assembly.

It is a further object of the invention to provide a shock-absorbent flashlight bulb assembly.

In accordance with these and other objects of the invention, an improved shock-resistant flashlight assembly is provided for protecting a flashlight bulb having a cylindrical body and having a base through which pass a pair of lead-pins. The bulb is mounted in a particular way to a cylindrical bulb chassis. The bulb chassis has a pair of pin-sockets on its front end for receiving the lead-pins of the bulb. The pin-sockets have lead contacts which extend through the bulb chassis and out of the rear surface of the bulb chassis to provide electrical connection of the lead-pins of the bulb to opposite terminals of a battery source contained in a battery housing. The base of the light bulb is mounted to the lead chassis such that the base of the light bulb is mounted adjacent to and spaced apart from the top surface of the bulb chassis;

A layer of resilient silicone material is then positioned in the clearance space between the spaced-apart base of the light bulb and the front surface of the bulb chassis to provide cushioning for axial movement and radial movement of the light bulb.

The flashlight assembly includes a cylindrical flashlight reflector housing which has a cylindrical body with a large axial bore formed therein for slideably receiving the cylindrical bulb chassis. A helical spring is contained in the large axial bore of the cylindrical flashlight reflector housing. This spring provides a biasing force which pushes the bulb chassis out of the reflector housing towards the rear of the flashlight. Rotation of the reflector housing with respect to the battery housing moves the bulb along the axis of the flashlight to change the focus of the flashlight beam. The flashlight reflector housing has a radially symmetric concave internal reflective surface formed in its front end around the central axis and a central axial bore is formed in the flashlight reflector housing to provide clearance for the light bulb and to also accommodates movement of the light bulb along the central axis;

An important aspect of the invention is that a heat resistant resilient O-ring is inserted in an enlarged rear portion of the central bore of the reflector housing. This O-ring has an internal surface which engages the cylindrical body of the light bulb such that the O-ring cushions the light bulb for radial movements of the light bulb with respect to the central axis of the reflector housing and so that the light bulb remains mechanically and optically aligned with the central axis. The durometer of the O-ring is between 60–70 and the durometer of the silicone layer between 50–60. The thickness of the O-ring is chosen to be sufficient to absorb shock from the bulb and the O-ring slip fits around the bulb to assure proper mechanical and optical alignment to the central axis of the bulb.

The cylindrical battery housing has external threads formed in one end for engagement with corresponding internal threads formed near the back end of the reflector housing. The cylindrical battery housing is designed to contain one or more batteries and is part of an electrical connection from the battery contact ring to one terminal of the batteries, where the other terminal of the batteries is connected to the battery contact coil spring.

The flashlight assembly further includes a second O-ring with a durometer of 70–80 which extends around the periphery of the rear surface of the bulb chassis to provide cushioning for rearward axial movement of the bulb chassis. A battery contact ring extends around the periphery of the rear surface of the bulb chassis next to and behind the other O-ring. One of the lead contacts of the pin-sockets which extend out of the rear surface of the bulb chassis is fixed to the battery contact ring. A battery contact coil spring extends away from the rear surface of the bulb chassis and the other one of the lead contacts of the pin-sockets is fixed to the battery contact coil spring. An insulated washer is positioned between the battery contact ring and the battery contact coil spring.

An improved flashlight bulb mounting assembly according to the invention includes the flashlight bulb, the heat-resistant O-ring which is around the bulb, the bulb chassis with the pair of pin sockets and their leads, the layer of resilient silicone material between the base of the light bulb and the front surface of the bulb chassis to provide cushioning for axial and radial movement of the light bulb, where the O-ring cushions the light bulb for radial movement and so that the light bulb remains aligned along the central axis. The flashlight bulb mounting assembly also includes a second O-ring at the rear surface of the bulb chassis to provide cushioning for rearward axial movement of the bulb chassis. The battery contact ring and the battery contact coil spring are separated by an insulated washer and provide connections to the opposite terminals of the battery.

BRIEF DESCRIPTION OF THE DRAWINGS

The accompanying drawings, which are incorporated in and form a part of this specification, illustrate embodiments of the invention and, together with the description, serve to explain the principles of the invention.

DETAILED DESCRIPTION OF THE PREFERRED EMBODIMENTS

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the invention is intended to cover any alternatives, modifications and equivalents, which may be included within the spirit and scope of the invention as defined by the appended claims.

Figure 1:
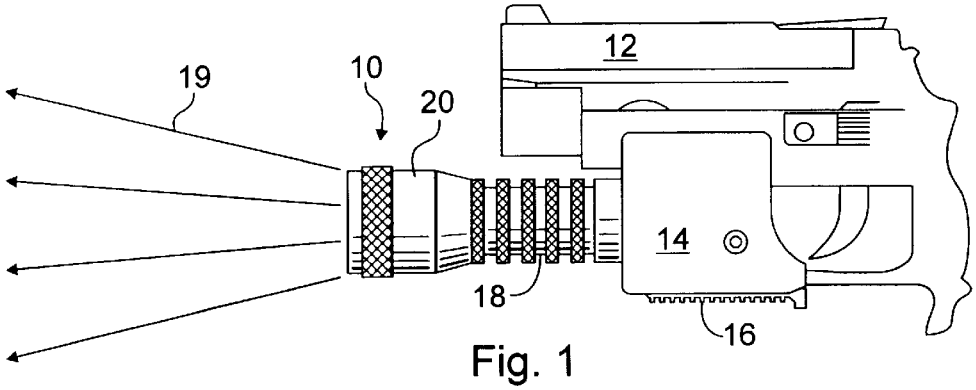
FIG. 1 is a side-elevation, enlarged external view illustrating a flashlight assembly incorporating a shock-absorbent flashlight bulb and reflector assembly which is shown mounted on a light and slide switch housing attached to a pistol.

FIG. 1 shows an application of an improved shock-absorbent flashlight assembly 10 mounted, for example, to a weapon such as a pistol 12. In the application shown in FIG. 1, the flashlight assembly 10 is mounted to a light and switch housing 14 which is attached beneath the barrel of the pistol 12. The light and switch housing 14 includes a slide switch 16 for turning a bulb 10 on and off. It should be understood that this invention is not limited only to weapons applications. There is a broad range of applications other than weapons per se for which this shock-absorbent flashlight assembly is useful. The invention is suitable for connection with any application in a system or environment which experiences shock and vibration.

The flashlight assembly 10 includes a metal cylindrical battery housing 18 for containing batteries such as lithium batteries. Adjustably screwed to one end of the metal cylindrical battery housing 18 is a cylindrical reflector subassembly 20 which is turned to adjust the focus of a beam, or light plume, 19, from the flashlight. It is desired that this light plume have a uniform intensity. The other end of the metal cylindrical battery housing 18 is fixed to the light and switch housing 14. The external surfaces of the cylindrical reflector subassembly 20 and the metal cylindrical battery housing 18 are knurled or scored to facilitate rotation of the reflector subassembly 20 with respect to the metal cylindrical battery housing 18 for adjustment of the beam focus of the flashlight assembly 10.

Figure 2:
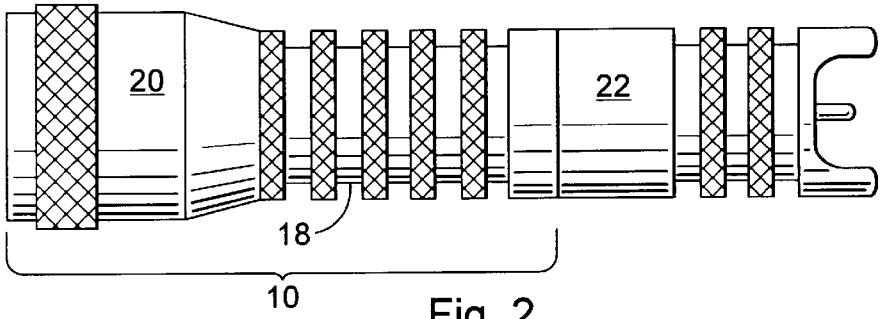
FIG. 2 is a side elevation view showing a flashlight assembly which incorporates a shock-absorbent flashlight bulb and reflector assembly according to the present invention.

FIG. 2 shows another application of the shock-absorbent flashlight assembly 10 for a tactical light system which is mounted to a weapon with a band encircling the cylindrical battery housing 18. In this case, the other end of the metal cylindrical battery housing 18 is attached, for example, to an optional toggle switch housing 22 while the cylindrical reflector subassembly 20 mounted to the other end of the metal cylindrical battery housing 18.

Figure 3:
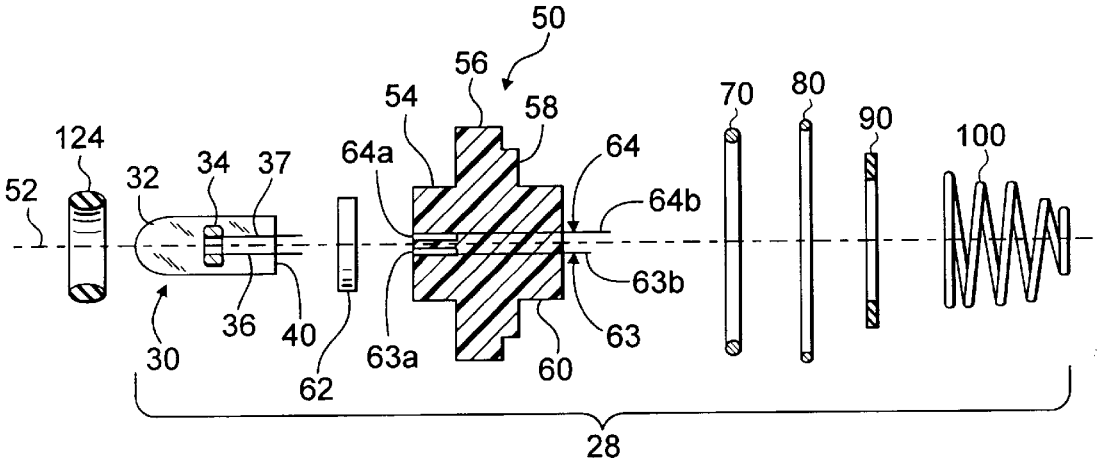
FIG. 3 is an exploded side elevation view showing a flashlight bulb subassembly according to the invention.

FIG. 3 shows the components of an improved flashlight bulb mounting subassembly 28 according to the invention. A cylindrical flashlight bulb 30, such as a high pressure Xenon type, has a bullet-shaped cylindrical glass globe 32 enclosing a filament 34. Inside the glass globe 32, the filament 34 is mounted to a respective inner end of one of a pair of lead-pins 36, 37. The outer ends of the lead-pins 36, 37 pass through a base 40 of the glass globe 32 for connection to a voltage source.

A bulb mounting subassembly, or bulb chassis, 50 is formed as a series of connected coaxial cylinders along a central axis 52. A front cylindrical section 54 extends from a front face of a larger central cylindrical section 56. From the rear face of the larger central cylindrical section 56 extends a somewhat smaller central cylindrical section 58. From the rear face of the somewhat smaller cylindrical section 58 extends a smaller rear cylindrical section 60. A pair of socket members 63, 64 are press-fit into the bulb chassis so that their embedded front pin socket ends **63*a*, 64*a* contact the bulb pins 36, 37 and so that their rear terminal leads contacts 63*b*, 64*b* project out of the bulb chassis 50**.

After the bulb is mounted to the bulb chassis 50, a layer of resilient silicone material 62 with a durometer of 50–60 is deposited between the base 40 of the cylindrical light bulb 30 and the front surface of the first cylindrical section 54 of the bulb chassis 50. The base 40 of the bulb 30 is spaced 0.020 inches from the front face of the cylindrical section 54 so that the layer of silicone material 62 is approximately 0.020 inches thick. This provides cushioning between the light bulb 30 and the bulb chassis 50 for axial movement and radial movement, or angular deflection, of the light bulb. The layer of silicone material 62 also adheres to the light bulb and prevents it from vibrating out of the lead-connectors. Alternatively, the layer of silicone of 50–60 durometers is a preformed washer of resilient material which is placed against the front face of the bulb chassis 50 prior to mounting the bulb.

A first O-ring 70 of 70–80 durometers extends around the somewhat smaller central cylindrical section 58 next to the outer edge of the rear face of central cylindrical section 56 to provide cushioning for rearward movement of the bulb chassis 50 along the axis 52 toward the battery housing 18.

A battery positive-contact copper ring 80 also extends around the somewhat smaller central cylindrical section 58 of the bulb chassis adjacent to the first O-ring 70.

An insulated washer 90 extends around the second cylindrical 60 section of the bulb chassis next to the battery contact ring 80.

A battery negative-contact spring 100 extends around the second cylindrical section of the bulb chassis 50 next to the insulated washer 90.

Figure 4:
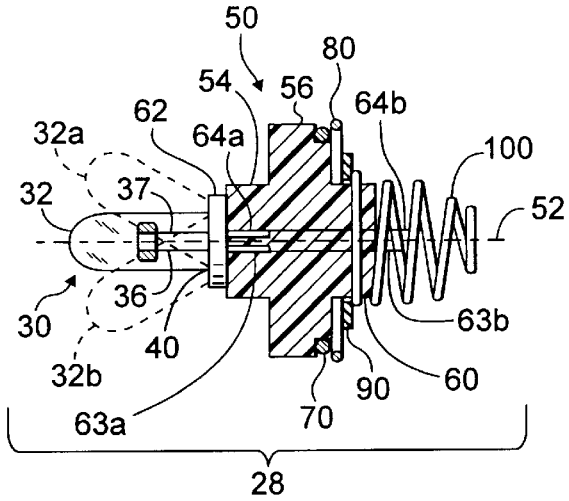
FIG. 4 is a partially-sectional side elevation view showing an assembled flashlight bulb subassembly according to the invention.

FIG. 4 shows an assembled flashlight bulb subassembly 28. The pin sockets 63*a*, 64*a* receive the respective outer ends of the lead-pins 36, 37 of the flashlight bulb 32 at the front side of the first cylindrical section 54 of the bulb chassis 50. As previously mentioned, a lead 64*b* from one of the sockets 64*a* in the bulb mounting subassembly 30 is spot welded to the battery positive-contact copper ring 80 which connects through the metal cylindrical battery housing 18 to the positive terminal of a battery string in the metal cylindrical battery housing. A lead 63*b* from the other socket 63*a* in the bulb mounting subassembly is soldered to one end of the battery negative-contact spring 100 so that the other end of the battery-contact spring 100 contacts the negative terminal of the battery string in the battery housing 18. The insulated washer 90 separates the positive-contact copper ring 80 from the battery negative-contact spring 100.

FIG. 4 shows the bulb 32 displaced radially from a central axis as indicated by the dotted envelopes of bulbs shown as reference numerals 32*a* and 32*b*.

Figure 5:
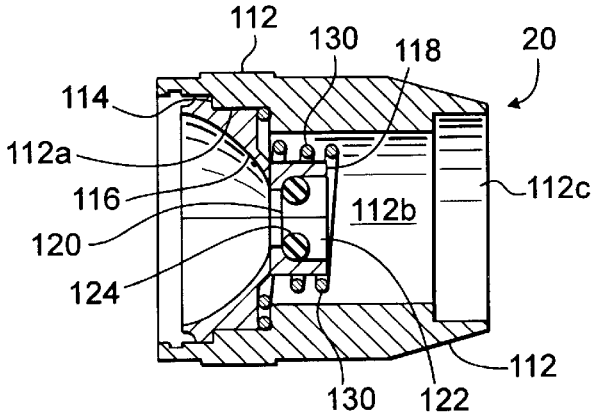
FIG. 5 is sectional partially-sectional side elevation view of a flashlight reflector subassembly with a shock absorbent O-ring mounted in an axial bore therein.

FIG. 5 illustrates a flashlight reflector subassembly 20. The flashlight reflector subassembly 20 includes a hollow cylindrical outer body or housing 112 with a series of axial bores formed therein including a front bore 112*a*, a central bore 112*b*, and a rear bore 112*c*. A parabolic reflector body 114 with a front light reflective surface 116 formed in its front surface is press fit into the front end of the outer body 112. Various lenses (not shown) are attached to the one end of the outer body 112 to cover the light reflective surface 116. A cylindrical back section 118 of the parabolic reflector body 114 projects away from the front light reflective surface 116. A front axial bore 120 is formed through the back section 118 and connects with a larger rear axial bore 122. The front axial bore provides sufficient clearance for a bulb. The rear axial bore contains an O-ring 124. A helical spring 130 fits within a cylindrical space formed between the outer surface of the back section 118 and the inside wall of the cylindrical outer body 112.

Figure 6:
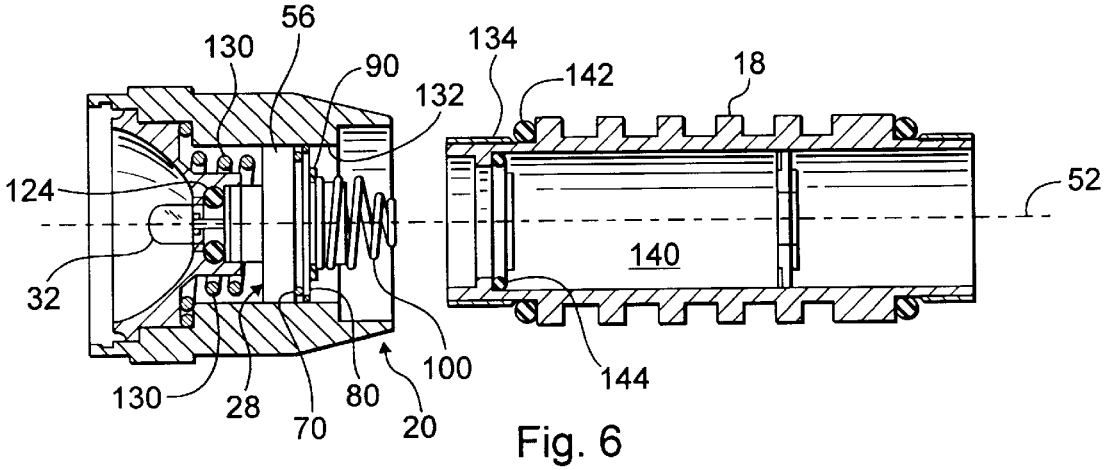
FIG. 6 is a partially sectional, exploded side elevation view of a battery housing subassembly and a flashlight reflector subassembly with a flashlight bulb assembly contained therein.

FIG. 6 shows a flashlight reflector subassembly 20 with a flashlight bulb mounting assembly 28 contained therein. The bulb 32 is engaged by the inside surface of the O-ring 124. The durometer of the O-ring 124 is between 60–70. The exterior surface of the first cylindrical section 54 of the bulb chassis 50 slips-fit engages the exterior surface of the axial bore 122 in the parabolic reflector body 114. The exterior surface of the central cylindrical section 56 of the bulb chassis 50 slip-fit engages the inner wall of the center bore 112*b*. The external surface of the front end of the battery housing 18 has external threads 134 formed therein for engagement with internal threads 132 formed in the inner wall of the center bore 112*b*.

The bulb 32 is mounted to a bulb mounting subassembly 28 which axially moves within the reflector subassembly 20 along the axis 52 of the reflector subassembly. The spring 130 mounted in the reflector subassembly 20 biases the bulb mounting subassembly 28 away from the reflector subassembly 20 so that the bulb mounting subassembly contacts the one end of the metal cylindrical battery housing. The axial position of the bulb mounting subassembly within the reflector subassembly is adjusted by screwing the external threads on the one end of the metal cylindrical battery housing into and out of corresponding internal threads in the cylindrical reflector subassembly. Adjustment of the axial position of the bulb along the axis of the reflector allows adjustment of the focus of the beam of light from the flashlight, as needed. The invention maintains the bulb filament along the axis, i.e., prevents radial displacement after a shock so that the shape and intensity of the light plumes from the reflector is uniform.

The battery housing assembly 18 includes one or more batteries 140. External threads 134 on the battery housing 18 engage internal threads 132 in the reflector subassembly 20. An O-ring 142 of 70–80 durometers seals this rotating connection. Another O-ring 144 of 70–80 durometers cushions the battery in the battery housing 18.

The durometer of the O-ring 124 in a preferred embodiment is between 60–70 and the durometer of the silicone 62 is between 50–60. A higher durometer would cause the entire system to fail and anything lower would make it unstable. The size of the O-ring that surrounds the lamp is a slip fit design to assure proper alignment to the mechanical and optical axis and to also act as a shock absorber. The O-ring which surrounds the flashlight should be of proper thickness because a thin O-ring would not have proper shock absorber properties.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed:

1. A shock-absorbent flashlight assembly, comprising:

a flashlight bulb having a cylindrical body and having a base through which pass a pair of lead-pins;

a cylindrical bulb chassis having a front surface and a rear surface, the bulb chassis having a pair of pin-sockets for receiving respective ones of the pair of lead-pins of the bulb near the front end of the bulb chassis, the pin-sockets having lead contacts which extend through the bulb chassis and out of the rear surface of the bulb chassis and which are adapted to provide electrical connection of the lead-pins of the bulb to opposite terminals of a battery source;

wherein the bulb chassis has the lead-pins of the light bulb mounted to the pin-sockets at the front surface of the bulb chassis such that the base of the light bulb is adjacent to and spaced apart from the front surface of the bulb chassis to provide clearance beneath the base of the bulb;

a layer of resilient silicone material which is positioned between the spaced-apart base of the light bulb and the front surface of the bulb chassis to adhere the bulb to the bulb chassis and to provide cushioning for axial movement of the light bulb;

a cylindrical flashlight reflector housing having a cylindrical body with a large axial bore formed therein for slideably receiving the cylindrical bulb chassis at its back end. the cylindrical flashlight reflector housing having a radially symmetric concave internal reflective surface formed in its front end around the central axis, a central axial bore is formed in the flashlight reflector housing to provide clearance for the light bulb and to accommodate movement of the light bulb along the central axis and radially away from the central axis:

a helical spring contained in the large axial bore of the cylindrical flashlight reflector housing for biasing the bulb chassis out of the cylindrical flashlight reflector housing;

a heat resistant resilient O-ring which is inserted in an enlarged rear portion of the central bore of the reflector housing, wherein the O-ring has an internal surface which engages the cylindrical body of the light bulb such that the O-ring cushions the light bulb for radial movements of the light bulb with respect to the central axis of the reflector housing and so that the light bulb remains aligned along the central axis; and a cylindrical battery housing which has external threads formed in one end for engagement with internal threads formed near the back end of the reflector housing where the cylindrical battery housing contains one or more batteries and which is part of an electrical circuit from a battery contact ring to one terminal of the batteries, where the other terminal of the batteries is connected to a battery contact coil spring.

2. The flashlight assembly of claim 1 including:

an other O-ring which extends around the periphery of the rear surface of the bulb chassis to provide cushioning for rearward axial movement of the bulb chassis;

a battery contact ring which extends around the periphery of the rear surface of the bulb chassis next to and behind the other O-ring, where one of the lead contacts of the pin-sockets which extend out of the rear surface of the bulb chassis is fixed to the battery contact ring;

a battery contact coil spring which extends away from the rear surface of the bulb chassis, where the other one of the lead contacts of the pin-sockets which extends out of the rear surface of the bulb chassis is fixed to the battery contact coil spring; and an insulated washer positioned between the battery contact ring and the battery contact coil spring.

3. The flashlight assembly of claim 1 wherein the durometer of the O-ring is between 60–70.

4. The flashlight assembly of claim 1 wherein the durometer of the silicone layer is between 50–60.

5. The flashlight assembly of claim 1 wherein the thickness of the O-ring is sufficient to absorb shock from the bulb and where the O-ring slip fits around the bulb to assure proper mechanical and optical alignment to the central axis of the bulb.

6. A flashlight bulb mounting assembly, comprising:

a bulb having a cylindrical body and having a base through which pass a pair of lead-pins;

a cylindrical bulb chassis having a front surface and a rear surface, the bulb chassis having a pair of pin-sockets for receiving respective ones of the pair of lead-pins of the bulb near the front end of the bulb chassis, the pin-sockets having lead contacts which extend out of the rear surface of the bulb chassis and which are adapted to provide electrical connection of the lead-pins of the bulb to opposite terminals of a battery source;

the bulb chassis having the lead-pins of the light bulb mounted to the pin-sockets at the front surface of the bulb chassis such that the base of the light bulb is adjacent to and spaced apart from the front surface of the bulb chassis to provide clearance beneath the base of the bulb;

a layer of resilient silicone material which is positioned in the clearance space between the spaced-apart base of the light bulb and the front surface of the bulb chassis to adhere the bulb to the bulb chassis and to provide cushioning for radial and axial movement of the light bulb;

a heat-resistant resilient O-ring which has an internal surface which engages the cylindrical body of the light bulb such that the O-ring cushions the light bulb for radial movements of the light bulb with respect to the central axis of the reflector housing and so that the light bulb remains aligned along the central axis;

a second O-ring which extends around the periphery of the rear surface of the bulb chassis to provide cushioning for rearward axial movement of the bulb chassis;

a battery contact ring which extends around the periphery of the rear surface of the bulb chassis next to and behind the second O-ring, where one of the lead contacts of the pin-sockets which extend out of the rear surface of the bulb chassis is fixed to the battery contact ring;

a battery contact coil spring which extends away from the rear surface of the bulb chassis, where the other one of the lead contacts of the pin-sockets which extends out of the rear surface of the bulb chassis is fixed to the battery contact coil spring; and an insulated washer positioned between the battery contact ring and the battery contact coil spring.

7. The flashlight assembly of claim 6 wherein the durometer of the O-ring around the bulb is between 60–70.

8. The flashlight assembly of claim 6 wherein the durometer of the silicone layer is between 50–60.

9. The flashlight assembly of claim 6 wherein the thickness of the O-ring is sufficient to absorb shock from the bulb and wherein the O-ring slip fits around the bulb to assure proper mechanical and optical alignment to the central axis of the bulb.

* * * * *